US005901814A

United States Patent [19]

Adifon et al.

[11] Patent Number: 5,901,814

[45] Date of Patent: May 11, 1999

[54] HYDRAULIC ELEVATOR HAVING A COUNTERWEIGHT

[75] Inventors: Leandre Adifon, Milan; Erminio Guaita, Cologno Monzese; Elio Taverna; Stefano Cantù , both of Milan, all of Italy

[73] Assignee: Otis Elevator Company, Farmington, Conn.

[21] Appl. No.: 08/738,739

[22] Filed: Oct. 28, 1996

[51] Int. Cl.[6] ..... B66B 11/04

[52] U.S. Cl. ..... 187/253

[58] Field of Search ..... 187/253, 404, 187/266

[56] References Cited

U.S. PATENT DOCUMENTS

| | | | |
|---|---|---|---|
| 307,998 | 11/1884 | Smith . | |
| 5,014,823 | 5/1991 | Pelto-Huikko | 187/17 |
| 5,048,644 | 9/1991 | Pelto-Huikko | 187/17 |
| 5,238,087 | 8/1993 | Garrido et al. | 187/17 |
| 5,281,774 | 1/1994 | Masaki | 187/110 |
| 5,443,140 | 8/1995 | Dieter et al. | 187/253 |

FOREIGN PATENT DOCUMENTS

| | | | |
|---|---|---|---|
| 534122B1 | 8/1995 | European Pat. Off. . | |
| 3621851A | 1/1987 | Germany | B66B 09/04 |
| 52-66251 | 11/1975 | Japan | B66B 09/04 |
| WO-09394014 | 1/1993 | WIPO | B66B 11/00 |

*Primary Examiner*—William E. Terrell
*Assistant Examiner*—K W Bower

[57] ABSTRACT

A hydraulic elevator includes a hydraulic ram and a counterweight that are directly roped. The hydraulic ram includes a single-acting cylinder, piston and yoke that are placed within the hoistway adjacent to the path of motion of an elevator car. The counterweight is positioned adjacent to the hydraulic ram and on the same side of the car as the hydraulic ram. The combination of the directly counterweighted hydraulic ram and the arrangement of the hydraulic ram, counterweight and car results in minimal power and space requirements.

6 Claims, 3 Drawing Sheets

HYDRAULIC ELEVATOR HAVING A COUNTERWEIGHT

TECHNICAL FIELD

The present invention relates to hydraulic elevators, and more particularly to hydraulic elevators having counterweights.

BACKGROUND OF THE INVENTION

Conventional hydraulic elevators include a hydraulically driven ram to raise an elevator car. Lowering of the car is typically accomplished by permitting fluid to exit the cylinder of the hydraulic ram and using the weight of the car to force the fluid out of the cylinder. A piston of the hydraulic ram may be directly engaged with the car or may be engaged with the car via a rope fixed to the hoistway and engaged with a sheave on a yoke on the piston. The latter arrangement provides the benefit of not requiring space under the hoistway for the hydraulic cylinder, although at the price of requiring additional space adjacent to the travel path of the car.

One advantage of hydraulic elevators as compared to traction elevators is the lower cost of the installation. A disadvantage, however, is the higher power requirements for the hydraulic pump as compared to similar sized traction elevators. This is in part the result of the hydraulic ram having to carry the weight of the car and the passenger load.

One method to reduce the power requirements of hydraulic elevators is to use a counterweight, as is done with traction elevators. In U.S. Pat. No. 5,238,087, issued to Garrido et al and entitled "Advanced Energy Saving Hydraulic Elevator", a double-acting hydraulic cylinder is used with a counterweighted hydraulic elevator. The double-acting hydraulic cylinder permits the car to driven in both the upward and downward direction, thus allowing the counterweight to be heavier than the empty car. The double-acting cylinder is more expensive than a single-acting hydraulic cylinder and requires more complex control of the hydraulic elevator. In another example disclosed in U.S. Pat. No. 5,014,823, issued to Pelto-Huikko and entitled "Apparatus for Improving the Performance of a Motor-Controlled Hydraulic Elevator", a single-acting hydraulic cylinder is used with a counterweight directly engaged with the car. This proposed solution requires additional hoistway space to accommodate the counterweight, thus minimizing the benefits.

The above art notwithstanding, engineers under the direction of Applicant's Assignee are working to develop inexpensive hydraulic elevators that minimize power requirements and hoistway space.

DISCLOSURE OF THE INVENTION

According to the present invention, a hydraulic elevator includes a hydraulic ram and a counterweight engaged with the piston of the hydraulic ram. The counterweight and the hydraulic ram are disposed adjacent to each other in the hoistway and on the same side of the path of travel of the car.

The features of engaging the counterweight directly to the hydraulic ram and positioning the adjacently and on the same side of the car results in minimizing the space required within the hoistway. In this way, the counterweighted hydraulic elevator may be used within a hoistway having dimensions similar to a traction elevator. As a result, an elevator according to the invention may be back-fit into existing traction elevator installations.

According further to the present invention, the hydraulic ram is a single-acting ram. This feature results in less complexity and lower cost as compared to a double-acting hydraulic ram. The single-acting ram is less expensive to install and requires the pump to operate in only the up direction.

In a particular embodiment of the present invention, the hydraulic ram includes a cylinder and a piston having a yoke. The counterweight is roped directly to the yoke in a 1:1 relationship. In other embodiments, the yoke and counterweight are roped in a 1:2 and 2:2 relationships as desired for distribution of loads on the piston.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
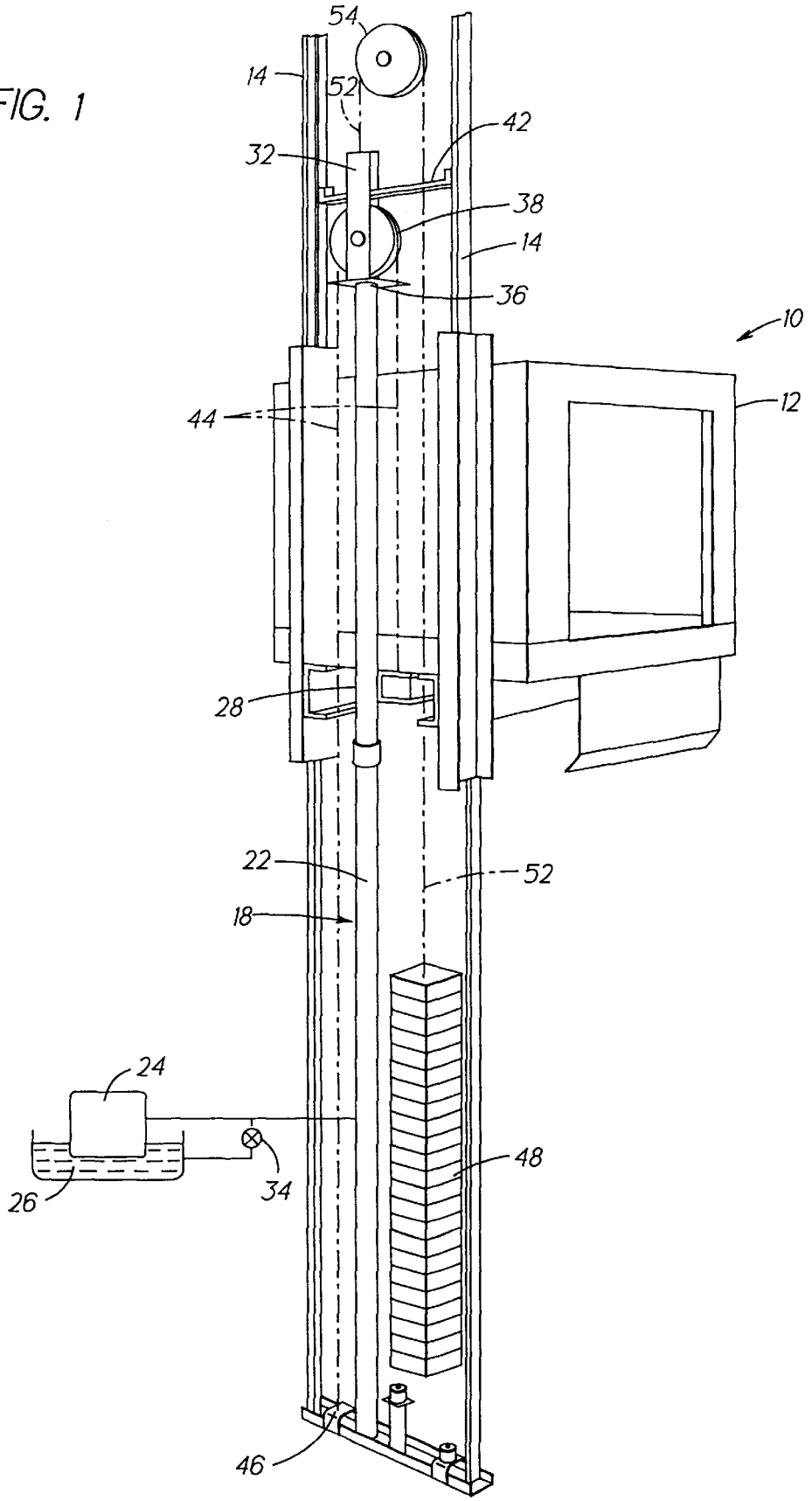
FIG. 1 is an illustration of a roped hydraulic elevator according to the present invention.

A hydraulic elevator 10 according to the present invention is illustrated in FIG. 1. The hydraulic elevator 10 includes a car 12 slidingly engaged with guide rails 14 for vertical movement within a hoistway 16.

The hydraulic elevator 10 also includes a hydraulic rain 18. The hydraulic ram 18 includes a single-acting hydraulic cylinder 22 connected to a pump 24 and a tank 26, a piston 28 and a yoke 32. The pump 24 forces fluid in the tank 26 to flow into the cylinder 22. The piston 28 is slidingly engaged with the cylinder 22 such that the piston 28 extends outward from the cylinder 22 as fluid is pumped into the cylinder 22. As used herein, single-acting means that the piston 28 is urged in only one direction, e.g. the upward direction, by the effects of the pump 24. A valve 34 is disposed between the cylinder 22 and the tank 26. If opened, the valve 34 permits fluid to flow from the cylinder 22 back into the tank 26.

The yoke 32 is attached to the distal end 36 of the piston 28 and includes a sheave 38 and a crosshead 42 engaged with the guide rails 14. The engagement with the guide rails 14 guides the motion of the yoke 32, and thereby the piston 28, as it travels vertically within the hoistway 16.

The sheave 38 is engaged with a rope 44 that extends from a fixed position 46 at the bottom of the hoistway 16 to the car 12. This results in a 1:2 roping between the hydraulic ram 18 and the car 12, i.e., the car 12 moves at twice the speed of the yoke 32 and places twice the car 12 and duty (passengers, freight, etc.) load on the yoke 32. As the piston 28 and yoke 32 is driven upward, the rope 44 is guided over the sheave 38 such that the car 12 is lifted vertically. Although only shown as a single sheave 38 and rope 44, it should be apparent to one skilled in the art that a plurality of sheaves and/or ropes may be used as required. In addition, as shown in FIG. 1 the rope has one end fixed to the car. As an alternative, the car may include a pair of sheaves mounted underneath the car, with the rope engaged with the pair of sheaves and fixed in the hoistway. This is a conventional underslung roping arrangement for the car.

The hydraulic elevator 10 further includes a counterweight 48. The counterweight 48 is attached to the yoke 32 by a rope 52 that extends over a sheave 54 mounted in the top of the hoistway 16. In this way, the counterweight 48 applies an upward force directly on the piston 28 to reduce the magnitude of pressure required from the pump 24. As a result, the power requirements of the hydraulic elevator 10 are minimized.

Figure 2:
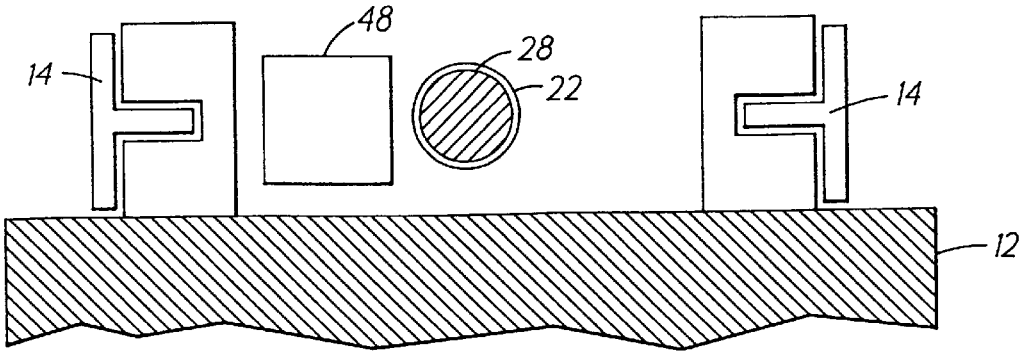
FIG. 2 is a top view of the hydraulic elevator of FIG. 1 to show the relative positioning of the car, hydraulic ram and the counterweight.

The car 12, hydraulic ram 18 and counterweight 48 are arranged as shown in FIG. 2. The hydraulic ram 18 and the counterweight 48 are adjacent to each other and on the same side of the car 12, and the counterweight 48 and the yoke 32 which is engaged with the guide rails 14 as shown in FIG. 1, have projections that overlap each other when viewed vertically within the hoist way 16. As a result of this compact arrangement, the cross-sectional space required within the hoistway 16 is minimized. This permits a hydraulic elevator according to the invention to be placed into smaller hoistways, such as those used for traction type elevators. In that situation, the hydraulic ram 18 and counterweight 48 may be placed in the portion of the hoistway 16 that was used by the traction elevator counterweight.

When the car is stationary, the weight of the car 12 and the duty load urge the yoke 32 and piston 28 downward into the cylinder 22. The weight of the counterweight 48 urges the yoke 32 and piston 28 in the opposite, or counter, direction. During operation, the car 12 is driven upward by operating the pump 24 to urge fluid to flow into the cylinder 22. The amount of fluid pressure in the cylinder 22 is required to exert a force greater than the difference between the counterweight 48 and the sum of the piston 28, yoke 32, car 12 and duty load. Downward motion of the car 12 is accomplished by opening the valve 34 and permitting fluid within the cylinder 22 to flow back into the tank 26. The downward force on the piston 28 is again the difference between the counterweight 48 and the sum of the piston 28, yoke 32, car 12 and duty load. In order to ensure sufficient load exists on the piston 28 to permit downward motion even with an empty car, i.e., no passenger load, the counterweight 48 should weigh the same as the car 12. If the car 12 is empty, the weight of the car, the piston 38 and yoke 32 will urge the piston 28 downward.

The reduction in motor power required as compared to a conventional hydraulic elevator without a counterweight may be estimated as follows. The equation for power is as follows:

$$P_{Hyd}=(2*(L_{car}+L_{Duty}))*\ 0.5V$$

where $P_{Hyd}$ is the Power required, $L_{Car}$ is the weight of the car, $L_{Duty}$ is the duty load, and V is the velocity of the car. For the roping configuration shown in FIG. 1, the load on the hydraulic ram is twice that of the car and duty load and the velocity of the ram is half of the car velocity. Assuming that the car load and passenger load are equal ($L_{car}=L_{Duty}$), this equation reduces to:

$$P_{Hyd}=2*L*V$$

If the effect of the counterweight is taken into account, the equation for power becomes:

$$P_{Hyd}=(2*(L_{Car}+L_{Duty})-L_{CWT})*0.5V$$

If it is assumed that the counterweight is equal to the car weight, then $L_{Car}=L_{Duty}=L_{CWT}$. The equation then becomes:

$$P_{Hyd}=1.5*L*V$$

Thus, the power required is reduced by one quarter over the same arrangement without a counterweight. If the configuration shown in FIG. 1 is combined with a pump motor having a thyristor connected in series with the motor to minimize starting current, the starting current for this configuration may be equivalent to or lower than for a comparable traction elevator. Minimizing the starting current requirements will minimize the installation costs.

Figure 3:
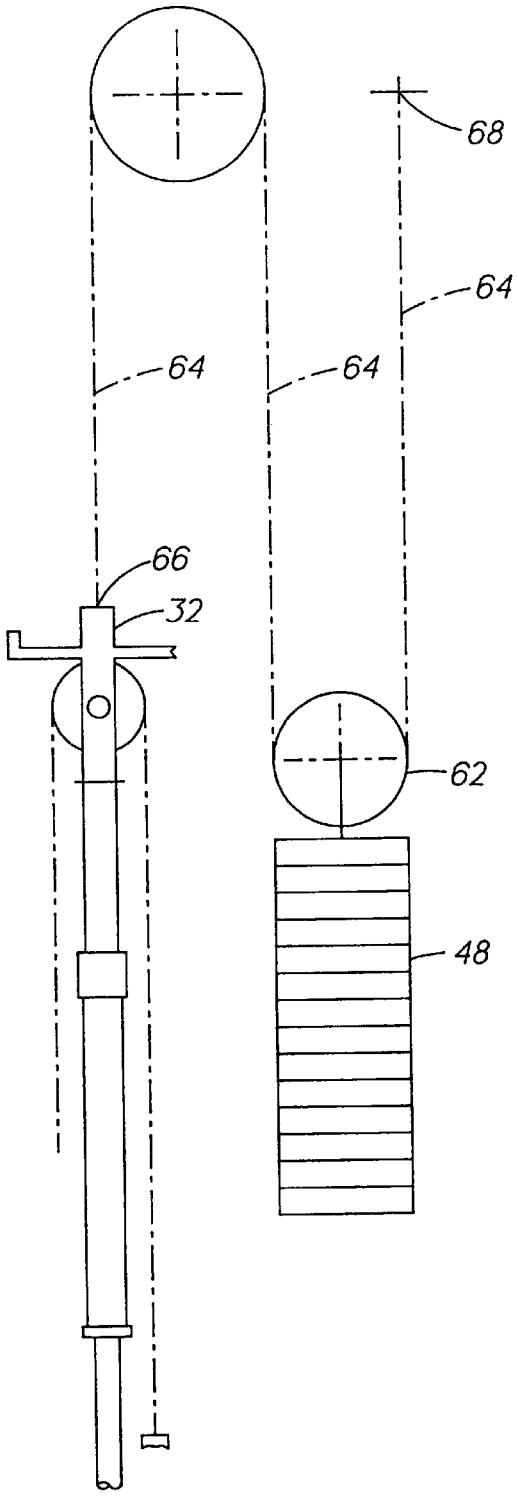
FIGS. 3 and 4 are schematic illustrations of the hydraulic ram and counterweight with alternative roping arrangements.
Figure 4:
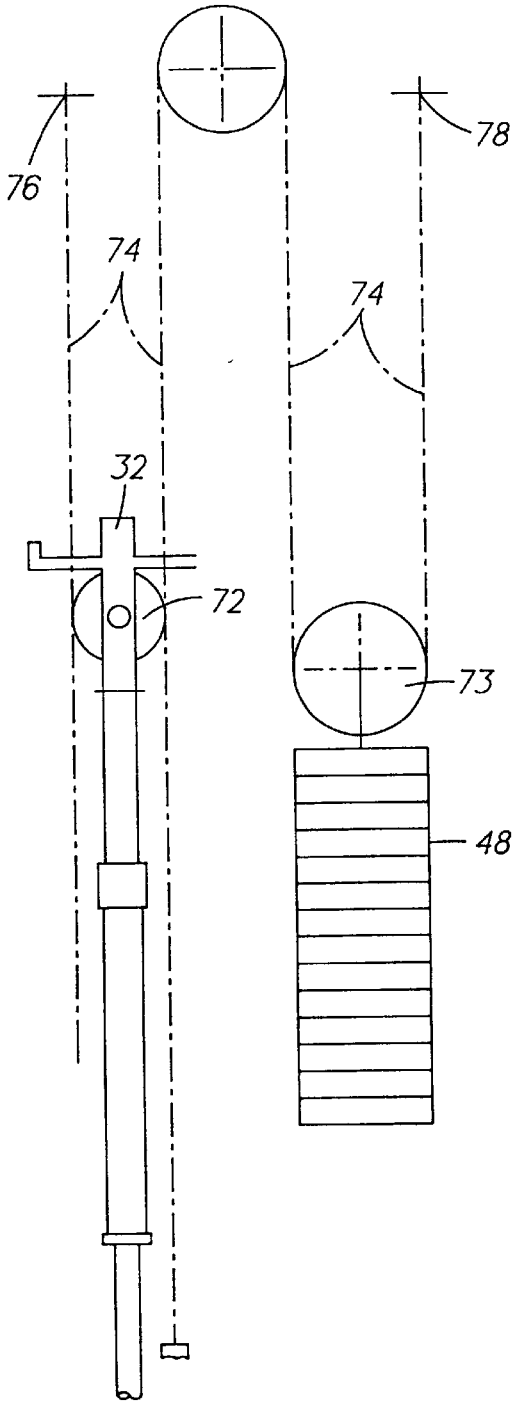

FIGS. 3 and 4 illustrate two other roping arrangements between the yoke 32 and the counterweight 48. In FIG. 3, the counterweight 48 includes a sheave 62 and the rope 64 has one end 66 fixed to the yoke 32 and the opposite end 68 fixed at the top of the hoistway 16. In this way, the counterweight 48 moves at half the speed and only half the distance of the yoke 32, and the load of the counterweight 48 on the yoke 32 is equal to half the weight of the counterweight 48 as compared to 1:1 roping. As a result, the car 12 moves at four times the speed of the counterweight 48.

This arrangement requires less space for the counterweight travel and reduces the number of ropes required for the counterweight.

In FIG. 4 is shown another arrangement that limits travel space for the counterweight and minimizes the number of required ropes. In this arrangement, both the counterweight 48 and the yoke 32 include a sheave 72,73 that is engaged with the counterweight rope 74, with the rope 74 having both ends 76,78 fixed to the hoistway 16. In this way, the yoke 32 and counterweight 48 move at the same speed and over the same distance, and the load of the counterweight 48 on the yoke 32 is equal to the weight of the counterweight 48. As a result, the car 12 moves at twice the speed of the counterweight 48 as in the arrangement shown in FIG. 1.

Although the invention has been shown and described with respect to exemplary embodiments thereof, it should be understood by those skilled in the art that various changes, omissions, and additions may be made thereto, without departing from the spirit and scope of the invention.

What is claimed is:

1. A hydraulic elevator having a car moveable within a hoistway, the hydraulic elevator including:

a hydraulic ram including a hydraulic cylinder disposed within a hoistway and adjacent to the path of travel of the car, the hydraulic cylinder being in fluid communication with a source of hydraulic fluid;

a piston slidingly engaged with the cylinder for longitudinal motion, wherein hydraulic fluid entering the hydraulic cylinder urges the piston to move outwardly from the hydraulic cylinder; and a yoke attached to the distal end of the piston, the yoke including a sheave;

a rope having one end disposed in a fixed relationship to the hoistway, the rope extending over the sheave and engaged with the car, such that the weight of the car urges the piston to move into the hydraulic cylinder;

pair of guide rails extending through the hoistway, wherein the yoke is engaged with the pair of guide rails to guide the yoke; and a counterweight traveling within the hoistway and engaged with the yoke to urge the piston to move outwardly from the hydraulic cylinder, the counterweight traveling in a direction opposite to the yoke, the path of the counterweight being adjacent to both the cylinder and the path of travel of the car, such that, within the hoist way a horizontal projection of the counterweight is separate from a horizontal projection of the yoke, and wherein the path of the counterweight extends between the pair of guide rails such that, within the hoist way, a vertical projection of the counterweight overlaps a vertical projection of the yoke.

2. The hydraulic elevator according to claim 1, wherein the hydraulic ram is a single-acting ram, such that upward motion of the car is accomplished by pumping hydraulic fluid into the cylinder and downward motion of the car is accomplished by permitting hydraulic fluid to flow out of the cylinder under the weight of the car.

3. The hydraulic elevator according to claim 1, further including a second sheave fixed in the hoistway and a second rope extending from the yoke to the counterweight to engage the counterweight with the yoke, the second rope being engaged with the second sheave.

4. The hydraulic elevator according to claim 3, further including a third sheave disposed on the counterweight, and wherein the second rope is engaged with the third sheave and the yoke and has one end fixed in the hoistway.

5. The hydraulic elevator according to claim 4, further including a third sheave disposed on the counterweight, and wherein the second rope is engaged with the third sheave and the sheave on the yoke, and has both ends fixed in the hoistway.

6. The hydraulic elevator according to claim 1, wherein the car is engaged with the pair of guide rails to guide the motion of the car within the hoistway.

* * * * *